US012753963B2

(12) United States Patent
Howse et al.

(10) Patent No.: US 12,753,963 B2
(45) Date of Patent: Oct. 6, 2026

(54) SHAVE-ICE ATTACHMENT FOR A STAND MIXER

(71) Applicant: WHIRLPOOL CORPORATION, Benton Harbor, MI (US)

(72) Inventors: Lynsey Alexandra Howse, St. Joseph, MI (US); Tyler Douglas Mathews, Niles, MI (US); Brandon T. Mock, St. Joseph, MI (US); John Jay Myers, Saugatuck, MI (US); Nicholas Hill Schutte, St. Joseph, MI (US); Joseph Snyder, St. Joseph, MI (US); Oi Man Siu, Hong Kong (CN); Bo Zhou, Huizhou (CN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 337 days.

(21) Appl. No.: 18/569,942

(22) PCT Filed: Jun. 21, 2021

(86) PCT No.: PCT/CN2021/101329
§ 371 (c)(1),
(2) Date: Dec. 13, 2023

(87) PCT Pub. No.: WO2022/266814
PCT Pub. Date: Dec. 29, 2022

(65) Prior Publication Data
US 2024/0280308 A1 Aug. 22, 2024

(51) Int. Cl.
*F25C 5/12* (2006.01)

(52) U.S. Cl.
CPC ..... *F25C 5/12* (2013.01)

(58) Field of Classification Search
CPC ..... F25C 5/12
See application file for complete search history.

(56) References Cited

U.S. PATENT DOCUMENTS 2,865,571 A 12/1958 Ferdon
6,012,660 A * 1/2000 Colman ..... F25C 5/12 241/37.5

(Continued)

FOREIGN PATENT DOCUMENTS

CN 2231486 Y 7/1996
CN 2377972 Y 5/2000

(Continued)

OTHER PUBLICATIONS

CN105276886A Translation (Year: 2025).*

*Primary Examiner* — Matthew Katcoff
(74) *Attorney, Agent, or Firm* — Price Heneveld LLP

(57) ABSTRACT

An attachment for a stand mixer includes an ice block-receiving chamber having an inner cavity and a lower side defining an output opening and a blade in a fixed position along a portion of the opening and partially extending into the inner cavity. The attachment for a stand mixer further includes a plunger mounted with respect to the ice block-receiving chamber so as to be moveable into the inner cavity toward the lower side along an axis and to be rotatable around the axis, the blade having an edge that extends axially away from the axis and a drive shaft having an input end coupleable to a power output of the stand mixer and a drive end mechanically coupled with the plunger to drive rotation thereof about the axis.

20 Claims, 10 Drawing Sheets

(56) References Cited

U.S. PATENT DOCUMENTS

| | | | | |
|---|---|---|---|---|
| 8,807,469 | B2 * | 8/2014 | Sung | A47J 43/255 241/285.2 |
| 10,443,917 | B2 * | 10/2019 | Kim | F25C 5/02 |
| 2016/0242600 | A1 | 8/2016 | Vacher | |
| 2019/0134835 | A1 | 5/2019 | Fung | |

FOREIGN PATENT DOCUMENTS

| | | | |
|---|---|---|---|
| CN | 203744631 | U | 7/2014 |
| CN | 105276886 | A | 1/2016 |
| CN | 111854254 | A | 10/2020 |
| JP | 2017142064 | A | 8/2017 |
| JP | 6492120 | B2 | 3/2019 |
| KR | 20170009244 | A | 1/2017 |
| WO | 2015052521 | A1 | 4/2015 |
| WO | 2017090647 | A1 | 6/2017 |
| WO | 2019073196 | A1 | 4/2019 |

* cited by examiner

SHAVE-ICE ATTACHMENT FOR A STAND MIXER

CROSS REFERENCE TO RELATED APPLICATION

This application is a national stage application, filed under 35 U.S.C. § 371, of International Patent Application No. PCT/CN2021/101329, filed on 21 Jun. 2021, which is incorporated by reference herein in its entirety.

FIELD OF THE DISCLOSURE

The present disclosure generally relates to a shave ice maker, and more specifically, to a shave ice making attachment that can be assembled and used in connection with a stand mixer.

BACKGROUND OF THE DISCLOSURE

Shave ice is an increasingly popular frozen dessert that offers an alternative to dairy-based frozen desserts. Notably, shave ice has been difficult to make at home, as the texture of the product is generally preferred to be characterized by relatively small shavings, which lends to a softer product with greater aeration. Traditional equipment for making shave ice at home or in otherwise small scales has not been sufficient in providing such texture.

SUMMARY OF THE DISCLOSURE

According to one aspect of the present disclosure, an attachment for a stand mixer includes an ice block-receiving chamber having an inner cavity and a lower side defining an output opening and a blade in a fixed position along a portion of the opening and partially extending into the inner cavity. The attachment for a stand mixer further includes a plunger mounted with respect to the ice block-receiving chamber so as to be moveable into the inner cavity toward the lower side along an axis and to be rotatable around the axis, the blade having an edge that extends axially away from the axis and a drive shaft having an input end coupleable to a power output of the stand mixer and a drive end mechanically coupled with the plunger to drive rotation thereof about the axis.

According to another aspect of the present disclosure, a shave-ice maker includes an ice block-receiving chamber having an inner cavity and a lower side defining an output opening and a blade in a fixed position along a portion of the opening and partially extending into the inner cavity and an upper housing releasably retaining the ice block-receiving chamber. The shave-ice maker further includes a plunger mounted with the upper housing so as to be moveable into the inner cavity toward the lower side along an axis and to be rotatable around the axis. The plunger includes an axle and a pusher extending radially outward from an operating end of the axle. A driven gear receives a portion of the axle such that the axle is slidably disposed through the driven gear along the axis and is rotatably fixed with the driven gear about the axis, and a biasing member exerts an axial force on a second end of the axle, positioned opposite the operating end, in a first direction toward the lower side of the ice block-receiving chamber and lever applying a force on a second end of the axle opposite the operating end.

According to yet another aspect of the present disclosure, a shave-ice making kit includes a primary unit having an ice block-receiving chamber with an inner cavity, a lower side defining an output opening, and a blade in a fixed position along a portion of the opening and partially extending into the inner cavity and a plunger mounted with respect to the ice block-receiving chamber so as to be moveable into the inner cavity toward the lower side along an axis and to be rotatable around the axis. The plunger includes an axle and a pusher extending radially outward from an operating end of the axle. The kit further includes an ice mold defining an inner mold cavity sized to receive a volume of water for freezing into an ice block for receipt within the inner cavity of the ice-block receiving chamber.

These and other features, advantages, and objects of the present disclosure will be further understood and appreciated by those skilled in the art by reference to the following specification, claims, and appended drawings.

Figure 1:
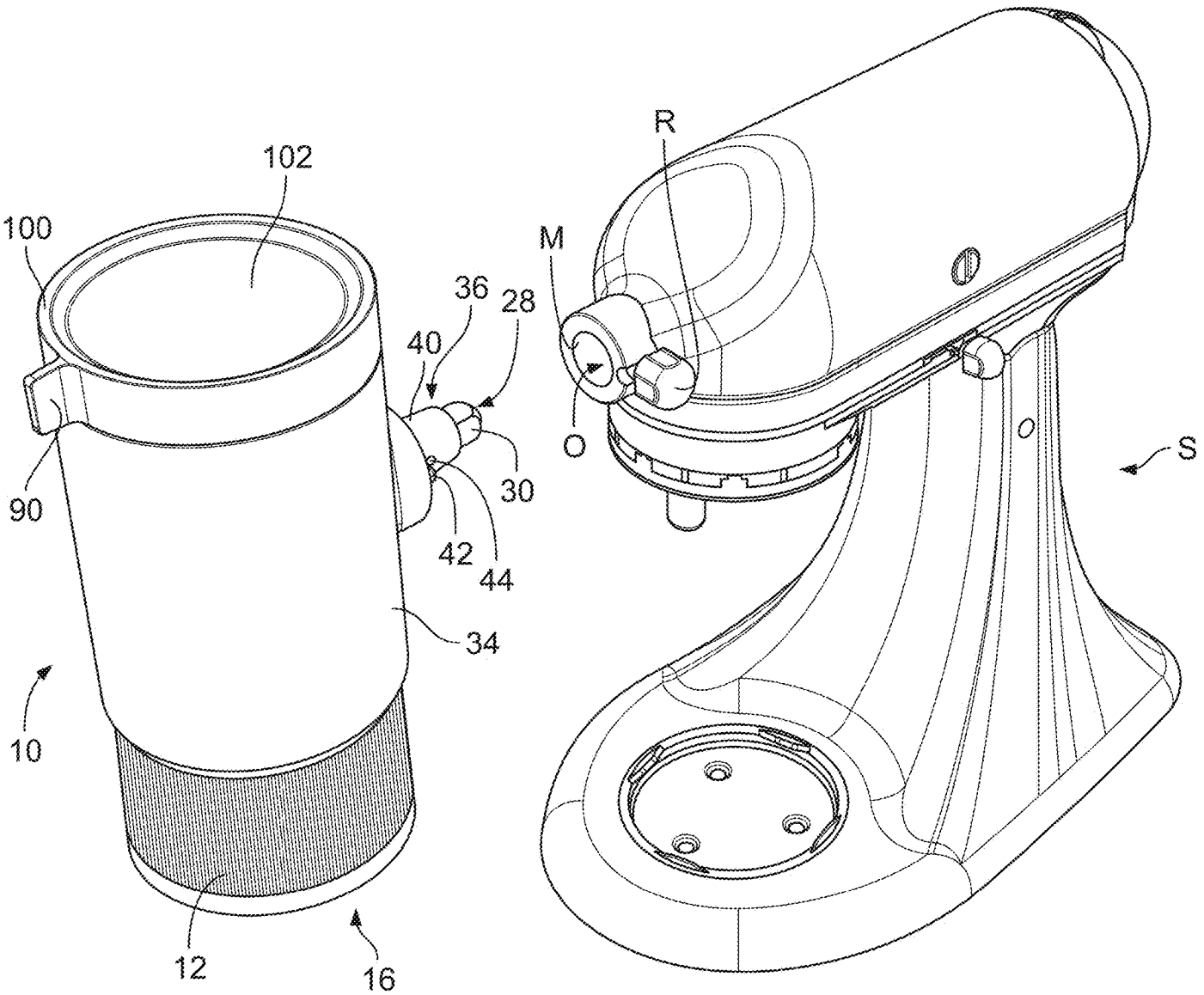
FIG. 1 is a shave ice making attachment according to an aspect of the present disclosure, aligned for assembly with a stand mixer.

The components in the figures are not necessarily to scale, emphasis instead being placed upon illustrating the principles described herein.

DETAILED DESCRIPTION

The present illustrated embodiments reside primarily in combinations of method steps and apparatus components related to a shave-ice maker including an attachment for a stand mixer facilitating the same. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-12, reference numeral 10 generally designates an attachment for a stand mixer for making a shave-ice food product utilizing functionality of both the stand mixer and the attachment such that the stand mixer, in combination with the attachment, may, in essence, function as a shave-ice maker. Accordingly, it is appreciated that the principles discussed herein can disclose or relate to a shave ice maker and may be adapted to a stand-alone unit having similar functionality or components to those discussed herein. The shave-ice attachment 10 includes an ice block-receiving chamber 12 having an inner cavity 14 and a lower side 16 defining an output opening 18 and a blade 20 in a fixed position along a portion of the opening 18 and partially extending into the inner cavity 14. The shave-ice attachment 10 further includes a plunger 22 mounted with respect to the ice block-receiving chamber 12 so as to be moveable into the inner cavity 14 toward the lower side 16 along an axis 24 and to be rotatable around the axis 24. The blade 20 has an edge 26 that extends axially away from the axis 24. The shave-ice attachment 10 further includes a drive shaft 28 having an input end 30 coupleable to a power output O of the stand mixer S and a drive end 32 mechanically coupled with the plunger 22 to drive rotation thereof about the axis 24.

Figure 2:
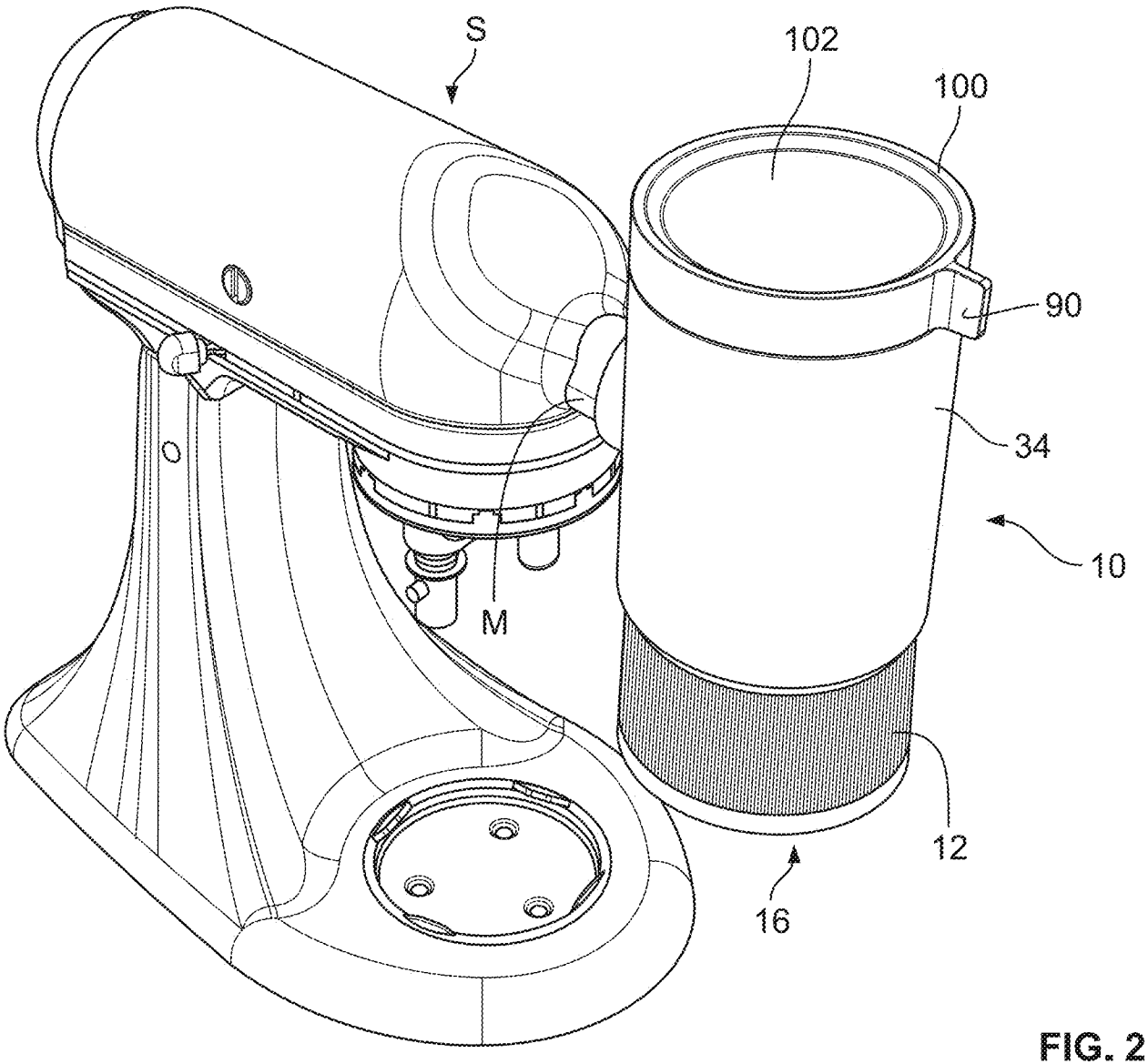
FIG. 2 is the shave ice making attachment of FIG. 1 assembled with the stand mixer.
Figure 3:
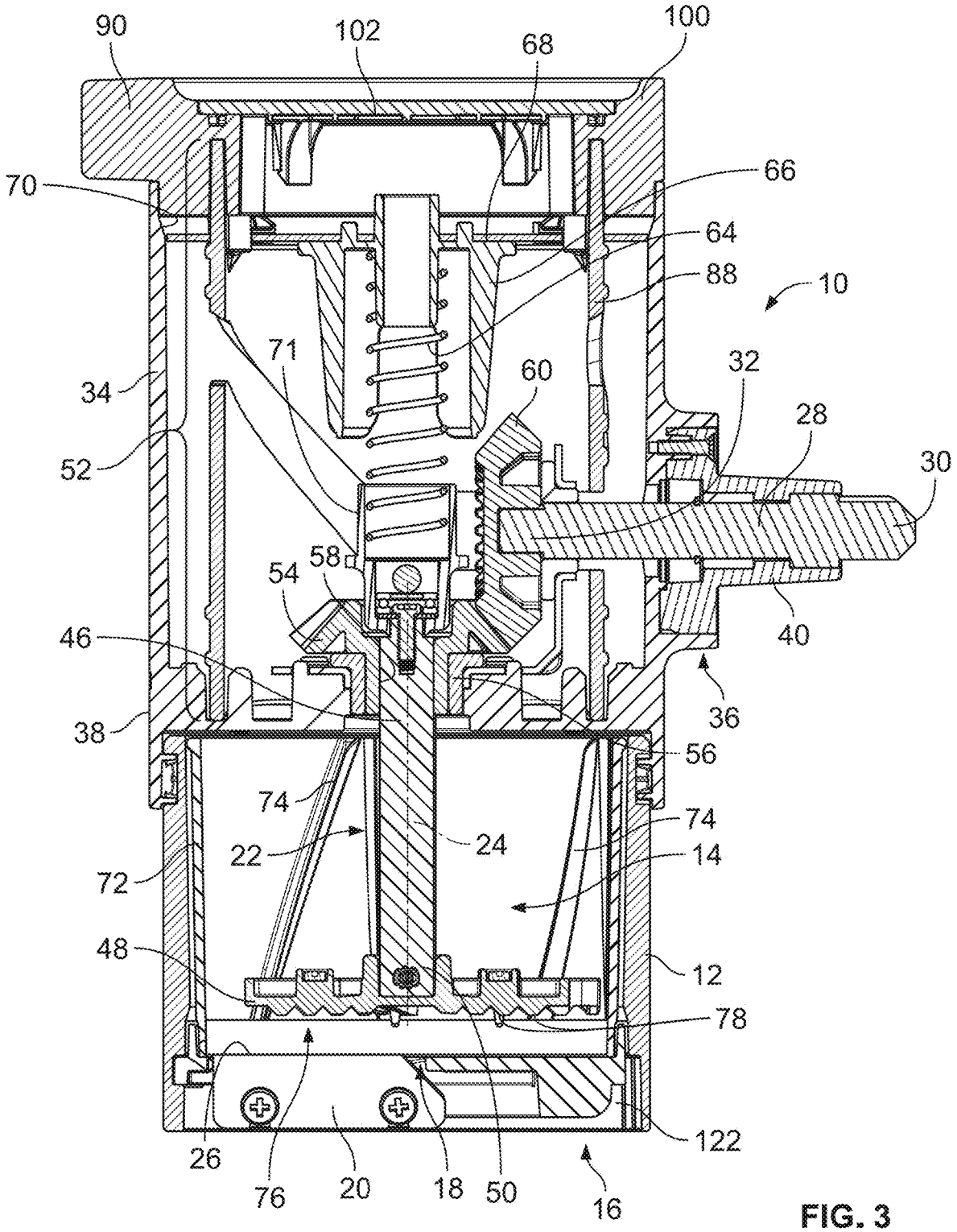
FIG. 3 is a cross-section view of the shave ice making assembly taken along the line III-III in FIG. 1.

Referring to FIGS. 1-3, the shave ice attachment 10 includes an upper housing 34 defining an input hub 36 with which the input end 30 of the drive shaft 32 is rotatably mounted. The input hub 36 is configured to be received with a mounting feature M of the stand mixer S surrounding the power output O thereof. In the example depicted in FIG. 1, the mounting feature is a cylindrical boss (that may define some inward draft to facilitate a close fit with the input hub 36 and/or other similar features of other attachments) with a retention screw R and an alignment detent A in proximity with the cylindrical boss B. In this manner, the input hub can define a cylindrical projection 40 with an alignment projection 42 adjacent thereto such that the shave ice attachment 10 is maintained in an upright operating position, when the cylindrical projection 40 (with may be tapered to match the draft of the cylindrical boss) is received in the cylindrical boss of the mounting feature M, by engagement of the projection 40 with the alignment detent A. The cylindrical projection 40 can be configured to interact with the retention screw R to retain the input hub 36 with the mounting feature M, including by including a detent 44 that receives a tapered end of the retention screw R to urge the cylindrical projection 40 into engagement with the boss of the mounting feature M, and/or by being of a material or configuration sufficient to withstand the pressure exerted thereon by the retention screw R. It is to be appreciated that the input hub 36 can be adapted for attachment with other mounting features M of other stand mixers S.

As further shown in FIGS. 1-3, a portion of the input end 36 of the drive shaft 28 extends outwardly beyond the input hub 36. In this manner, the input end 36 can engage with the power output O of the stand mixer S when the input hub 36 is assembled with the mounting feature M of the stand mixer S. In the illustrated example, the power output O is in the form of a socket positioned at an inner end of the above-described cylindrical boss B of the mounting feature M. In this manner, the input end 30 of the drive shaft 28 can have a profile configured to engage with the socket of the power output O such that rotation of the power output O within the mounting feature M powers rotation of the drive shaft 28. As can be appreciated, the power output O is mechanically coupled to the motor of the stand mixer S, including the speed control and reduction mechanisms thereof, such that operation of the stand mixer S operates the power output and, in turn any accessories mounted with the mounting feature M, including the shave-ice attachment discussed herein. As shown in FIG. 2, when the shave-ice attachment 10 is assembled with the mounting feature M of the stand mixer M, the lower side 16 of the ice block chamber 12 is maintained above the work surface W on which the stand mixer S is positioned, such that a bowl or other receptacle can be positioned beneath the output opening 18 to catch the ice shavings produced by the shave ice attachment 10 under the power of the stand mixer S, as discussed further below.

Figure 5:
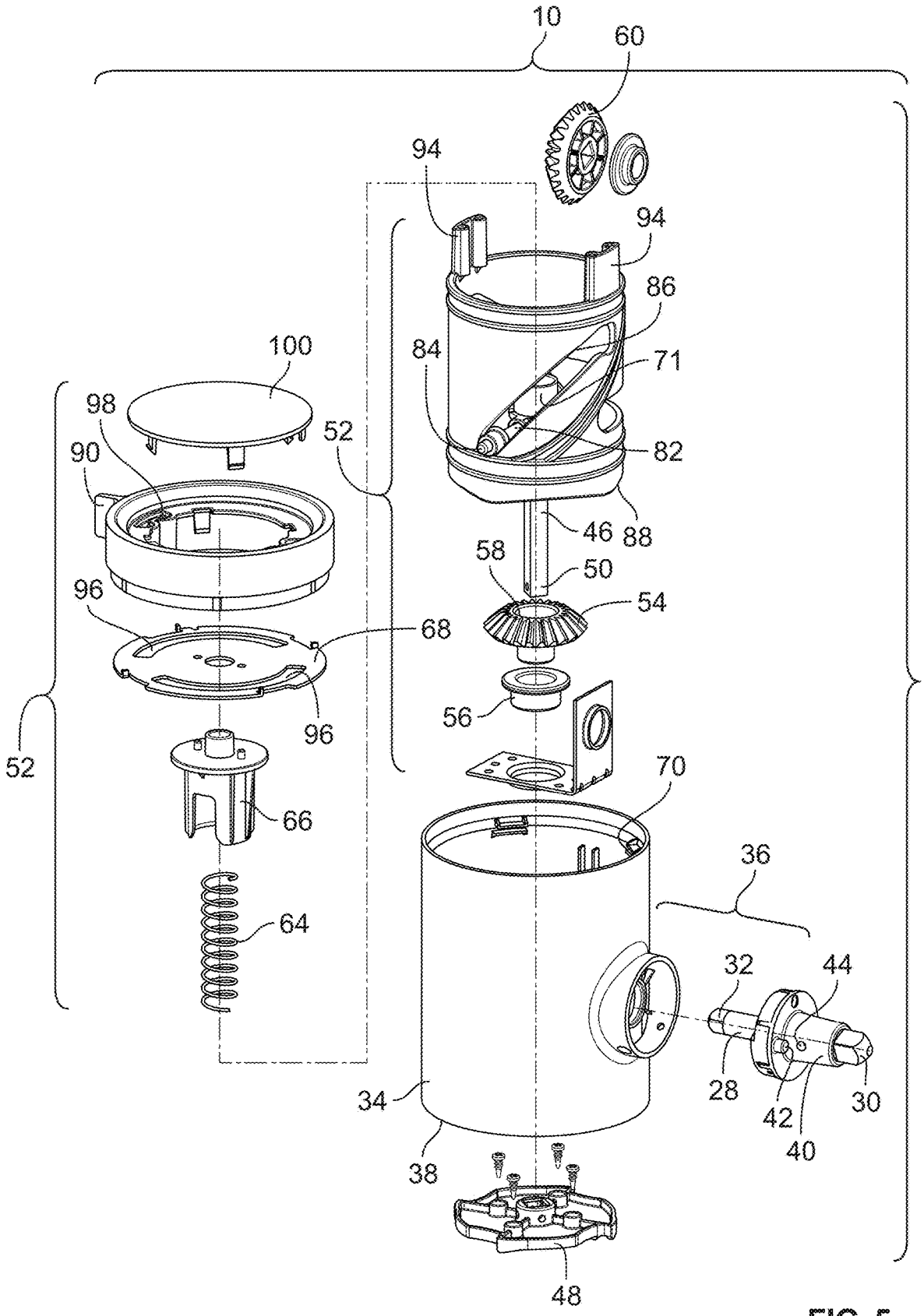
FIG. 5 is a further exploded view of the shave ice making assembly.

As shown in FIG. 3, the upper housing 34 encloses the drive end 32 of the drive shaft 32. The upper housing also defines a lower end 38 with which the ice-block receiving chamber 12 is removably attachable. In this respect, the plunger 22 is mounted with the upper housing 34 so as to be mounted with respect to the ice block-receiving cavity 12, as discussed above, by attachment of the ice-block receiving cavity 12 with the upper housing 34. In particular, the plunger 22 includes an axle 46 and a pusher 48 extending radially outward from an operating end 50 of the axle 46. In this manner, the upper housing 34 receives and encloses a mounting mechanism 52 to facilitate driven movement of the plunger 22 along and around the axis 24. The axle 46, in particular is received in and extends through a driven gear 54 that is rotatably disposed in a bushing 56 that extends through the lower end 38 of the upper housing 34. More specifically, the driven gear 54 can define a central opening 58 having an at least partially non-circular profile such that the axle 46, having a similar at least partially non-circular profile, can be rotationally fixed with respect to the driven gear 54, while not being rigidly fixed thereto such that the axle 46 can be slidably received through the central opening 58 to facilitate the above-mentioned movement of plunger 22 along axis 24 (FIG. 5). The driven gear 54 is, in turn, arranged in a mesh configuration with a drive gear 60 fixed on the drive end 32 of the drive shaft 28. By this arrangement, the rotation of the drive shaft 28, as effected by the engagement with the rotating power output O of the stand mixer S, causes rotation of the plunger 22 about axis 24. As shown, both the driven gear 54 and the drive gear 60 are configured as bevel gears of the same size to achieve a 1:1 ratio between the power output O and the operating end 50 of the axle 46. It is to be appreciated that other arrangements are possible, including for gear trains that effect rotation at different relative angles and at different ratios, to achieve different operating speeds, torques, directions, and the like, including by incorporation of additional gears, including but not limited to, planetary arrangements and other known mechanisms.

As can be appreciated, the pusher 48 is fixed on the operating end 50 of the axle 46 such that rotation of the axle 46, as described above, causes rotation of the pusher 48. As shown, the extension of axle 46 through the opening 58 in driven gear 54 positions the pusher 48 on an exterior side of the lower end 38 of the upper housing 34. In this manner, the pusher 48 can operably engage an ice block 62 received in the inner cavity 14 of the ice block chamber 12 to turn the ice block 62 within the ice block chamber 12, at least approximately about axis 24. As mentioned above, the positioning of blade 20 with the edge thereof 26 both positioned within the inner cavity 14 and extending away from axis 24 is such that the rotation of the ice block moves the ice block 62 over the edge 26 of the blade 20 to effect "shaving" of ice crystals off of the ice block that fall through the output opening 18 for collection in a mass to provide a food product. Such a food product is generally referred to as shave ice or shaved ice and can be made from ice that has been flavored and/or sweetened to impart the same flavor profile on the final product. Alternatively, the shave ice can be flavored after collection of the characteristic ice crystals. As generally appreciated, the composition of the shave ice is the same as that of the ice block subjected to the shaving process (at least prior to the addition of any other flavoring), but is physically comprised of smaller pieces or the ice for easier and more pleasant manipulation and consumption. The shaving process also expands the volume of the ice and introduces air thereinto. The particular size of the ice pieces/crystals can be varied, for example by the sharpness, angle, and positioning of the blade 20 with respect to the inner cavity 14, as discussed further above, as well as with the amount of pressure with which the ice block 62 is brought into contact with the edge 26 of blade 20. Notably, all of these factors may be balanced with the available speed and torque output of the stand mixer S or that may otherwise be applied at the operating end 50 of the axle 46.

To provide a desired level of force on pusher 48 along the axis 24 (i.e., with movement of axle 46 in an outward direction with respect to the opening 58 in driven gear 54) and, in particular, toward blade 20 to force the ice block 62 into engagement with the edge 64, the mounting mechanism 52 includes a spring 64 disposed between a fixed portion of the upper housing 34 and a second end of the axle 46 opposite the operating end 50. As shown in FIGS. 3 and 5, the spring can be received between a cup 66 mounted on a supporting disc 68 that is fixed against a flange 70 on the upper end of the outer housing 34 and a lifting block 71 that defines the second end of the axle 46 (such as by being fixedly connected thereto. In this manner, the plunger 22 can be moved, against the compression of spring 64 between the lifting block 71 and the cup 66 from an extended position, shown in FIG. 3, for example, to a retracted position, shown in FIG. 4 (as well as FIGS. 8 and 9, referenced further below) to accommodate the height of the ice block 62 therein. The spring 64 can be selected or otherwise configured to provide a desired amount of force (for example, between 5 lbs. and 20 lbs. and in one embodiment about 10 lbs.) on the ice block 62 in an initial condition that generally corresponds with the position of plunger 22 in the retracted position and to maintain a desired level of force (for example at least about 3 lbs. or up to about 7-10 lbs.) as the ice block 62 is reduced in size by having the portion thereof that contacts the blade 20 being shaved off by rotation of the ice block 62, which corresponds with extension of the plunger 22 toward the extended position.

Figure 4:
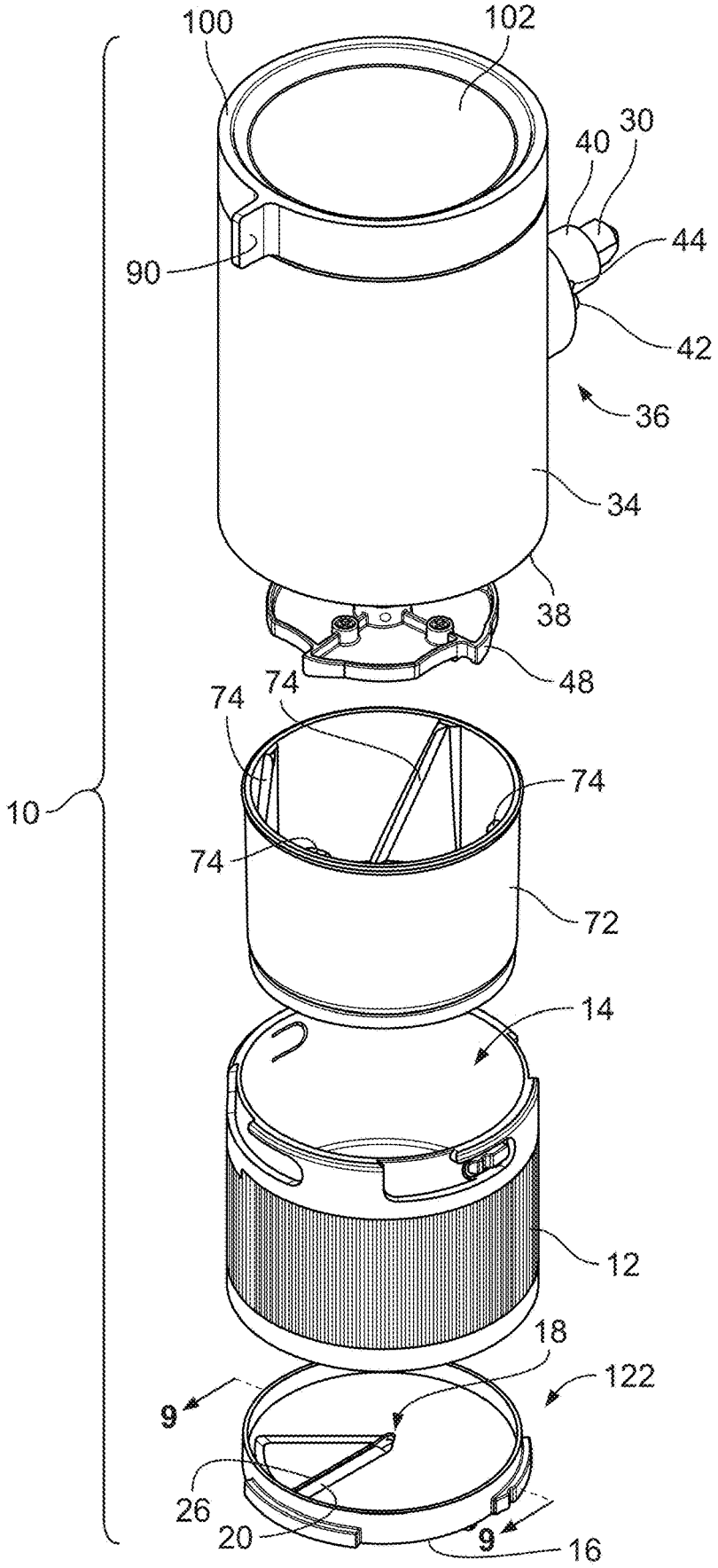
FIG. 4 is a partially exploded view of the shave ice making assembly.

To further facilitate engagement of the ice block 62 the shave ice attachment 10 further includes a sleeve 72 receivable within the inner cavity 14 of the ice block-receiving chamber 12, as shown in FIGS. 3 and 4. The sleeve 72 can be configured for a close fit within the inner cavity 14 and/or can interlock or key-in with corresponding features or geometry of the ice block-receiving chamber 12 such that the sleeve 72 remains generally fixed in position within the inner cavity 14 during operation of the shave ice attachment 10. As shown, the sleeve 72 includes at least one spiral rib 74 that extends inward from the sleeve 72 with respect to the inner cavity 14. In other words, the rib 74 extends from the body of the sleeve 72 to a position further inward into the cavity 14. In the example shown in FIG. 4, the sleeve 72 includes four spiral ribs 74 spaced at generally even intervals around the circumference of the sleeve 72, although other implementations are possible, depending, for example on the particular geometry of the ribs 74. The spiral ribs 74 extend toward the lower side 16 of the ice block-receiving chamber 12 and around the sleeve in an azimuth direction around the periphery of the sleeve 72 so as to correspond with the rotation of the plunger 22 about the axis 24, as driven by the drive shaft 28.

In particular, the present example of the shave ice attachment 10 is configured for rotation of the plunger in a counter-clockwise direction from the viewpoint of FIG. 4 (i.e. when viewed from the top of the attachment 10 in a downward direction). In this manner, the spiral ribs 74 can be configured to extend downward toward the lower side 16 of the ice block-receiving chamber 12 as the ribs 74 extend in the counter-clockwise direction. In this manner, the ribs 74 can, at least periodically, engage with portions of the ice block 62 as the ice block 62 is rotated within the inner cavity 14 and over the edge 26 of blade 20. Due to the geometry of the ribs 74, such engagement can provide an additional downward force on the ice block 62 to supplement the force provided by the pusher 48 and/or to help maintain contact of the ice block 62 with blade 20 including, for example, reducing "skipping" or other upward movement of the ice block 62 off of the blade. Notably, during the initial stages of the ice-shaving operation, the ice block 62 will be general more frozen than at the later stages of the operation, as time in the ambient environment and frictional warming may cause partial thawing of the ice block 62. In this manner, the ribs 74 can at least provide the described downward force during such initial stage of the process. Notably, the amount and duration of contact can be influenced by the geometry of the ribs 74 and the configuration of the ice block 62, as discussed further below. In one example, the ribs 74 can extend inward at a distance of between about 2 mm and about 4 mm and can have widths that generally match the distance by which the ribs extend, to maintain the structural strength of the ribs 74. The ribs 74 can additionally be configured to provide a somewhat sharpened edge along the leading portion thereof to facilitate engagement of the ice block 62.

Returning to FIG. 3, the pusher 48 is shown with a gripping feature 76 configured to engage a portion of the ice block 62 when positioned within the ice block-receiving chamber 12.

In particular, the downward force of spring 64 on the axle 46 can drive the pusher 48 into contact with the ice block 64 such that the gripping feature 76 can engage with the ice block 62 (including by partial chipping, melting, etc.) to increase the friction realized between the pusher 48 and the ice block 62. In this manner the torque applied on the ice block 62 by rotation of the pusher 48 can be improved such that the plunger 22 rotates the ice block 62 over the blade 20 with a desired level of consistency and force to produce the desired ice shavings. As shown further in FIG. 8, the gripping feature 76 can include an arrangement of spikes 78 molded into the pusher 48. In the depicted arrangement, the spikes are generally pyramid-shaped and may include a partial edge extending along an apex thereof, the edge being oriented in a radial direction to engage with the ice block 62 during rotation. Additionally, the spikes 78 can be angled toward the direction of rotation to grip into the operative surface of the ice block 62. The spikes can be arranged in generally perpendicular lines 80 extending outward away from axis 24. The illustrated arrangement shows a total of 20 such spikes 78, although other arrangements are possible.

As also shown in FIG. 4, with additional reference to FIGS. 5 and 6, the mounting mechanism 52 can be additionally configured to maintain the plunger 22 in the retracted position, for example, to facilitate loading of an ice block 62 into the shave ice attachment 10, as discussed further below). In this manner, the lifting block 71 that defines the second end of the axle 46 can have attached therewith a pair of oppositely-extending lifting arms 82 (that may, for example be defined on a single bar that passes through a portion of the lifting block 71). The outward ends 84 of the lifting arms 82 can engage with angled tracks 86 of an annular member 88 disposed within the upper housing 34. The annular member 88 can be received within the upper housing 34 such that rotation of the annular member 88 moves the tracks 86 in opposite directions corresponding with upward or downward movement of the lifting arms 82 while the axle 46 remains fixed (such as by the drive shaft 28 being maintained in a fixed position when the stand mixer S is turned off). In this manner, the annular member 88 can be coupled (at least in rotation) with a lever 90 positioned on an exterior of the upper housing 34. In this manner, the lever 90 can be rotated in a first direction (clockwise, when viewed from above, in the present example) to effect rotation of the annular member 88 in the same direction. This rotation can cause the angled tracks 86 to exert an upward force on the ends 84 of the lifting arms 82 against the force of the spring 64 to urge the plunger 22 into the retracted position. The upper ends 92 of the angled tracks 86 can define generally horizontal or somewhat downwardly-extending portions to receive the ends 84 of the lifting arms 82 to maintain the plunger 22 in the retracted position upon further rotation of the lever 90. In a similar manner, rotation of the lever 90 in an opposite (e.g. counter-clockwise) direction can move the ends 84 of the lifting arms 82 out of the ends 92 of the angled tracks 86, thereby allowing movement of the plunger 22 toward the extended position, including into contact with an ice block 62 positioned within the ice block-receiving chamber 12.

Figure 6:
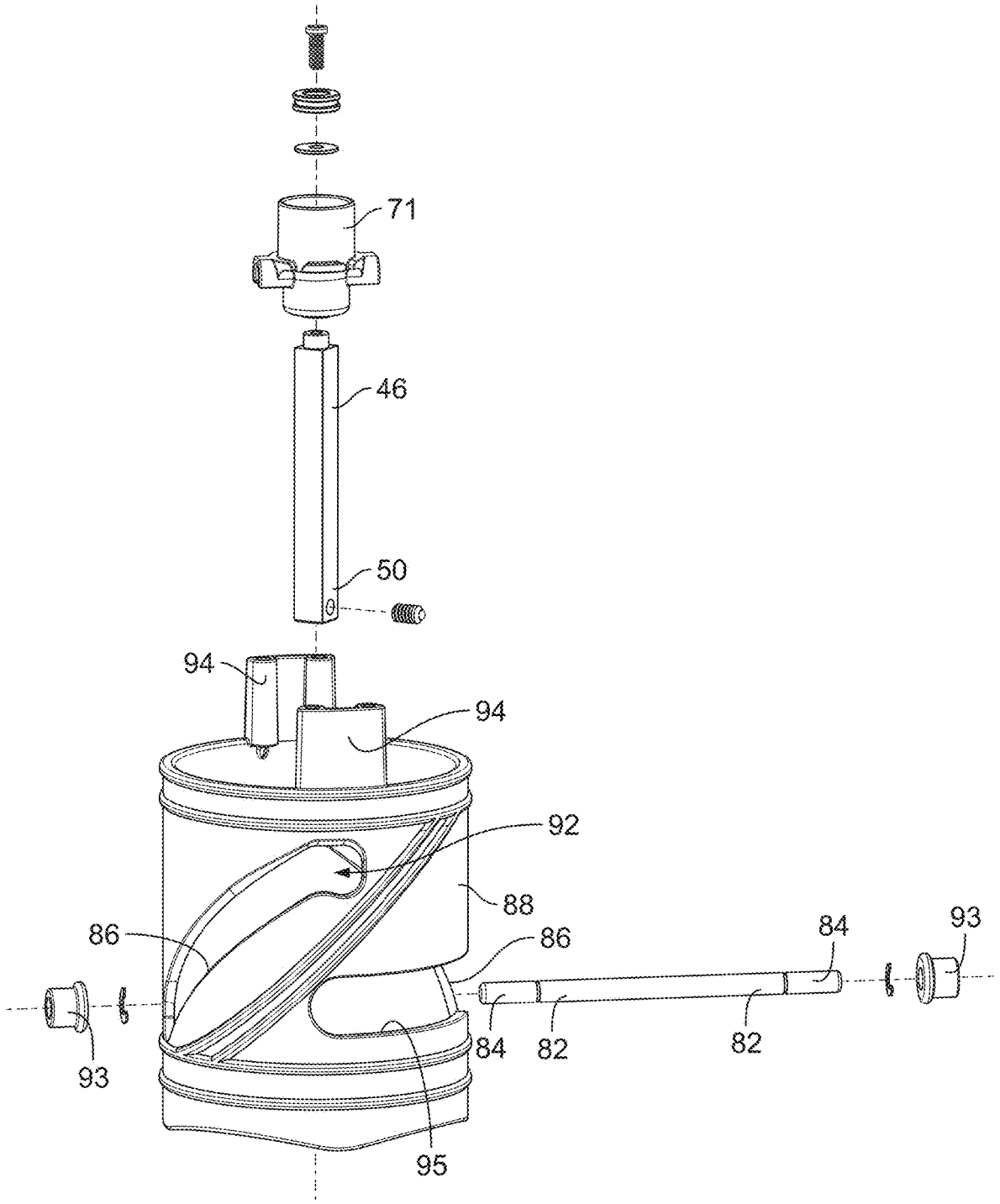
FIG. 6 is a further exploded view of a mounting assembly of the shave ice making assembly.

As shown in FIG. 6, the ends 84 of the lifting arms 82 can be defined on bushings 93 assembled onto the arms 82 and sized to be generally closely received in the angled tracks 86. The bushings 93 can be configured to roll or remain fixed on the lifting arms and can, additionally, be of a material that reduces friction against the angled tracks 86 during rotation of the annular member 88. The angled tracks 86 can extend around the annular member 88 through an angle of about 90° such that rotation of the lever 90 through substantially the same angle effects the above-described lifting and maintaining of the plunger 22 into the retracted position. The angled tracks 86 can extend upward along the annular member 88 by a distance comparable to that achieved by the angular extension thereof to effect about a 1:1 ratio between the azimuth direction and the axial direction. The particular ratio, however, can be adjusted to achieve a desired mechanical advantage to oppose the selected characteristics and configuration of the spring 64, as discussed above. Additionally, the angled tracks 86 may be curved to achieve a consistent force at the lever 90 despite the increasing force required to compress spring 64. Additionally one of the angled tracks 86 can include a lower horizontal extension 95 to account for variations in the geometry and tolerance of the tracks 86, as well as the lifting arms 82. To release the plunger from the retracted position, the lever 90 only needs to be rotated through a distance sufficient to move the ends 84 of the lifting arms 84 out of the detented ends 92 of the angled tracks 86.

As shown in FIG. 5, the annular member 88 can be rotationally coupled with the lever 86 by a pair of extensions 94 that project upwardly from the annular member 88 through slots 96 in the disc 68 that is positioned within the upper housing 34 above the cup 66. The extensions 94 can be received in corresponding openings 98 in an annular body 100 from which the lever 90 projects. The annular body 100 can be rotationally mounted on the upper housing 34 and enclosed by a cap 102 to provide a finished appearance for the exterior of the upper housing 34.

Turning to FIGS. 7A-9, the present shave ice assembly 10 can be included as a primary unit in a shave ice making kit that further includes at least one ice mold 104. In other variations, the primary unit in such a kit can comprise a stand-alone shave ice maker according to the principles, and with one or more of the particular features, discussed above with a similar ice mold 104. The particular ice mold 104 included in the kit can be configured to produce an ice block 62 sized to achieve a desired fit within the interior cavity 14 of the ice block-receiving chamber 12. In the particular example of the shave ice maker 10 discussed above, the ice block 62 can have a diameter configured to achieve a close fit, including with a slight interference with the ribs 74 of sleeve 72 discussed above. In the particular example depicted in FIGS. 7A-7D, the ice mold 104 can be configured to produce an ice block 62 (FIG. 7D) having a diameter 106 of between about 70 mm and 80 mm and, in one example, about 78 mm and a height 108 of between about 40 mm and 50 mm and, in one example, about 44 mm. As shown, the ice mold 104 can define an inward draft to facilitate removal of the ice block 62 from the mold 104 such that the above-described diameter can be a maximum diameter. The ice mold 104 can be configured with a step 110 used to indicate an extent to which the mold 104 is to be filled with liquid 62' by the user (FIG. 7B), with the step 110 being positioned away from an upper edge 110 of the mold 104 to allow for receipt of the depicted lid 112 and to provide headspace for expansion of the water-based liquid 62' during freezing.

Figure 7D:
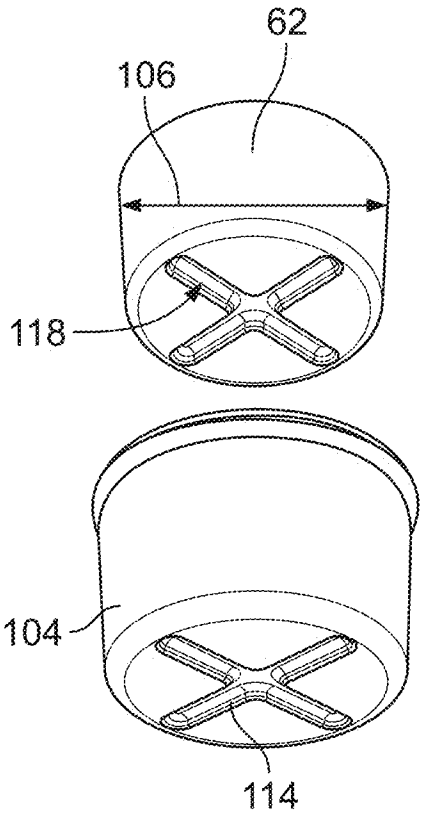
FIGS. 7A-7D show sequential steps in making an ice block for processing by the shave ice making assembly using a mold according to an aspect of the disclosure.
Figure 7C:
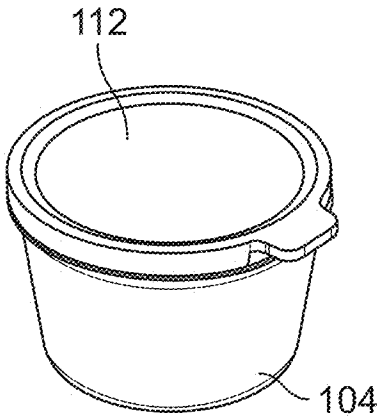
Figure 8:
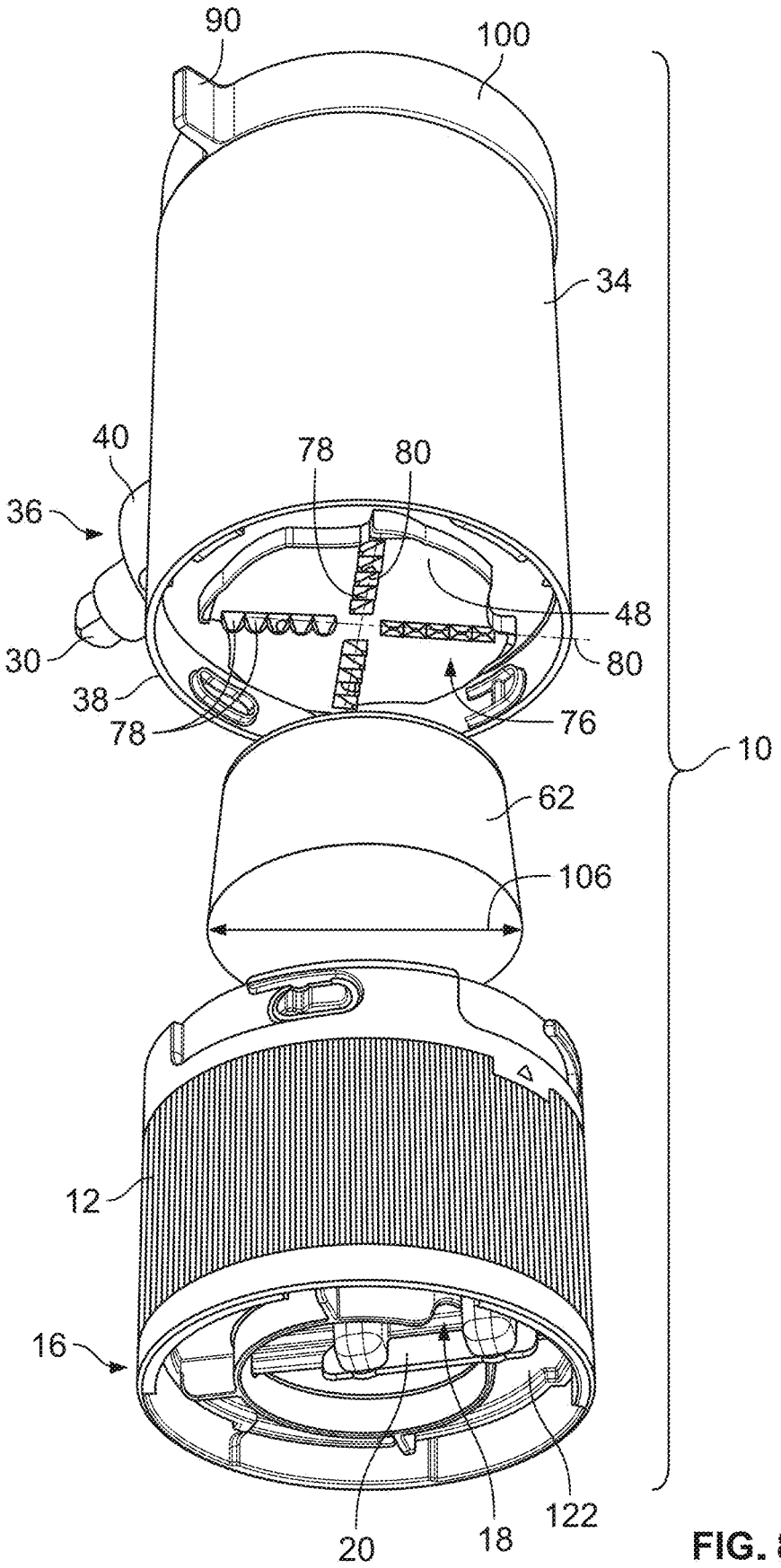
FIG. 8 is an assembly view of an ice block and the present shave ice making attachment.

As particularly shown in FIGS. 7D and 8, the ice mold 104 can include a protrusion 114, and the ice mold 104 includes at least one protrusion 114 extending into the inner mold cavity 116 to impart a receiving feature 118 in the ice bock 104. As can be appreciated, the receiving feature 118 can be shaped to correspond with the above-described gripping feature 76 of the pusher 48. In particular, the protrusion 114 can defines first and second perpendicular ridges 120 such that the protrusion 114 generally defines an X-shape. The ridges 120 can be in locations within the cavity 1160 that correlate with locations of the first and second perpendicular lines 80 along which the spikes 78 of the gripping feature 76 extend. In this manner, the receiving feature 118 can define a cavity that is an inverse of the ridges 120 of the protrusion 114. Accordingly, the receiving feature 118 can receive the spikes 78 of the pusher 48 for mutual engagement, which can further facilitate gripping of the ice block 62 by the gripping feature 76. Notably, the configuration of the gripping feature 76 may not be such that the ice block has to be initially positioned with the spikes 78 positioned in the receiving feature 118. In particular, the spikes 78 may sufficiently grasp the ice block 62 for turning in positions outside of the receiving feature 118, but may engage with the receiving feature 118, if slipping occurs, to improve the torque transmission between the pusher 48 and the ice block 62. In a further example, the kit can include a plurality of similarly-configured or practically identical molds 104 to allow the user to make multiple ice blocks 62 simultaneously.

Figure 9:
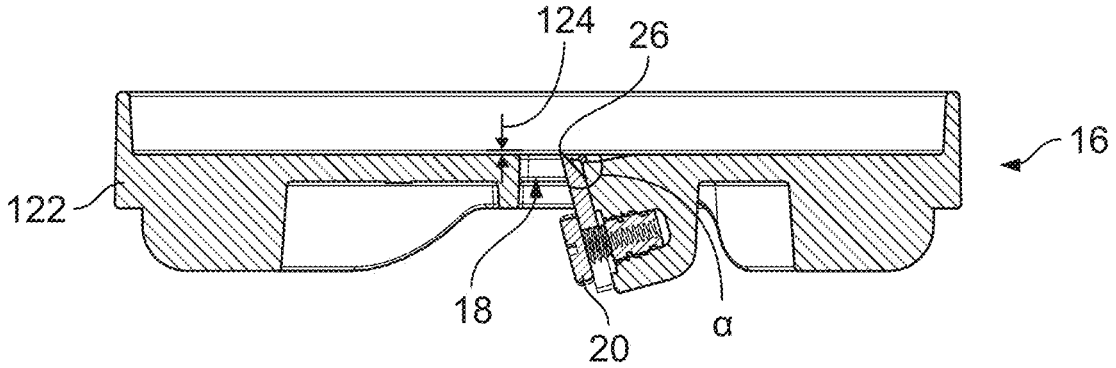
FIG. 9 is a cross-section view of a blade assembly of the shave ice making attachment taken along the line 9-9 in FIG. 4.
Figure 10:
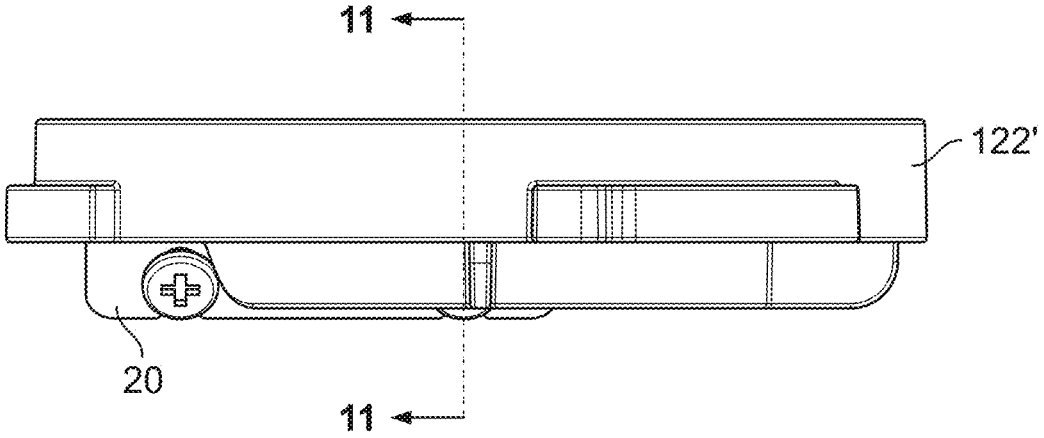
FIG. 10 is a side view of an alternative blade assembly of the shave ice making attachment.
Figure 11:
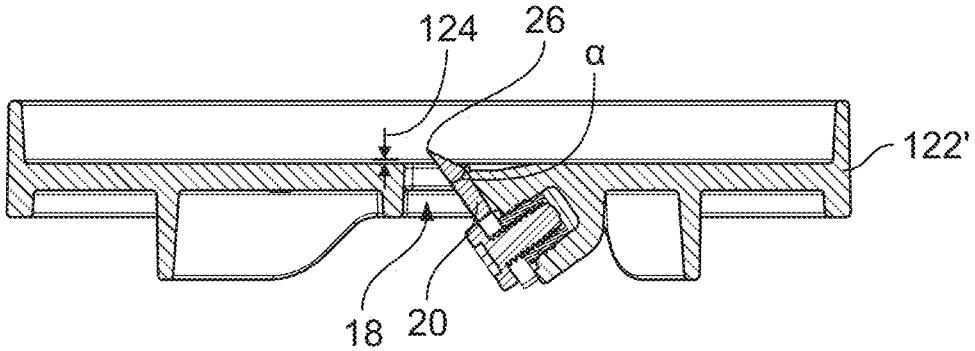
FIG. 11 is a cross-section view of a blade assembly, taken along the line 11-11 in FIG. 10.

Turning to FIGS. 9-11, the kit may further include a plurality of blade assemblies 122 that can be assembled onto a body of the ice block-receiving chamber 12 to define the lower side 16 of the ice block-receiving chamber 12 and the inner cavity 14. In particular, the blade assemblies 122 can be configured to produce differently-sized ice shavings from the above-described rotation of ice block 62 over the respective blades 20 of the blade assemblies 122. In one aspect, the relative coarseness of the ice shavings can be controlled, to an extent, by the angle $\alpha$ of the blade relative to the output opening 18 and the distance 124 by which the blade 20 extends into the inner cavity 14. Accordingly, the example blade assembly 122 shown in general in the above-referenced figures, as well as in detail in FIG. 9 can position the associated blade 20 at a steep angle $\alpha$ (e.g., between about 75° and about 85°) with respect to the extent of output opening 18 and such that the distance 124 by which the blade 20 extends into the inner cavity 14 is less than 1 mm (e.g., between about 0.5 mm and about 0.7 mm) to produce relatively fine ice shavings. Additionally, the blade assembly 122' shown in FIGS. 10 and 11 can be configured to produce relatively coarse ice shavings by more aggressive blade 20 positioning. In particular, the angle $\alpha$ at which the blade 20 is positioned can be between about 55° and about 65° or, in one example, about 60°. The blade 20 can also be positioned to extend into the inner cavity at a distance 124 of between about 1 mm and about 2 mm. Other configurations are possible and the kit can, accordingly, be provided with additional variations for further customization of the particular ice shaving size achieved.

Figure 7B:
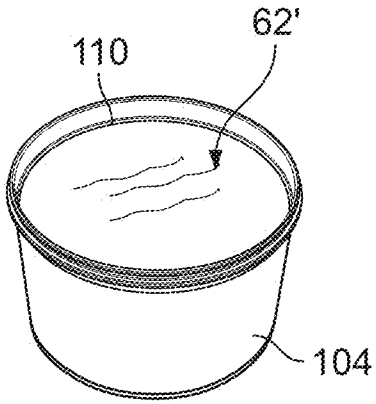
Figure 7A:
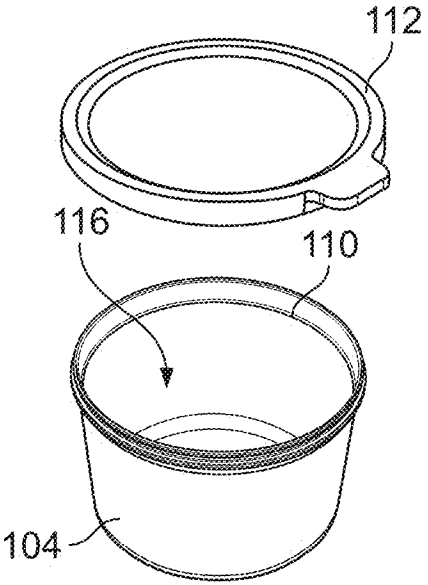

In using the shave ice assembly, depicted above, a user can first obtain the desired number of molds 104 corresponding with the number of ice blocks 62 that the user would like to make (FIG. 7A). The molds 104 can then be filled with liquid to the step 110 corresponding with the size of the ice bock 62 to be made. In various examples, the liquid can include water to make "plain" shave ice that can be flavored after the shaving process is complete, such as by the addition of various syrups, juices, or the like. In another example, the liquid can be flavored, such as by the addition of flavor concentrates other food products (e.g., fruit) to water or by adding juice (which may be diluted) to the mold 104 (FIG. 7B). In any such example, it is to be appreciated that the various molds 62 can be simultaneously filled with the same or different liquid compositions. The associated lid 112 or lids 112 are then assembled with the mold 104 (FIG. 7C) for placement in a freezer until the liquid in the mold. When the liquid has hardened the ice block 62 can be removed from the mold 104 (FIG. 7D).

Figure 12:
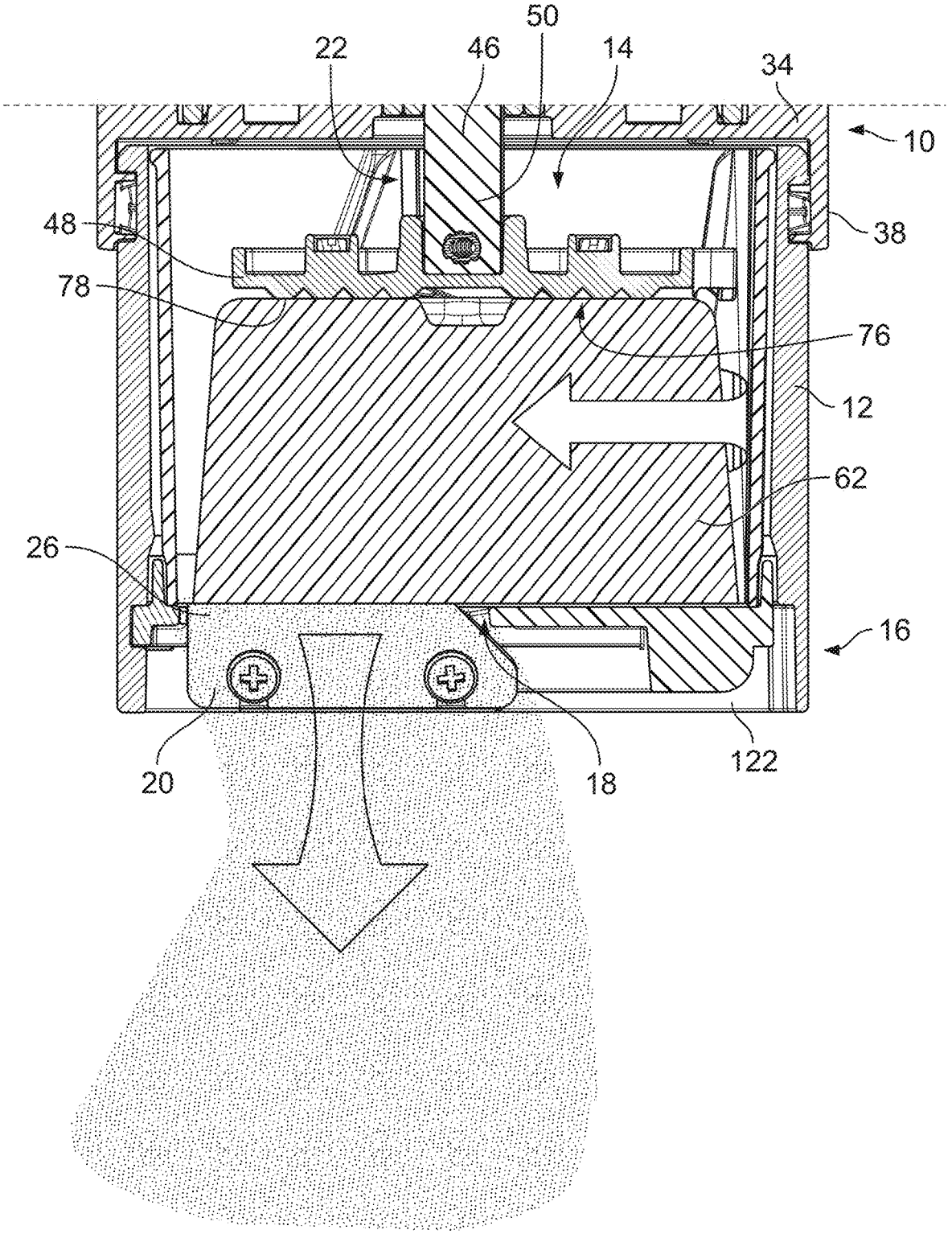
FIG. 12 is a cross-section view of the shave ice making attachment during processing of an ice block into ice shavings.

When the desired ice blocks 62 are ready for processing, the shave ice assembly 10 can be assembled with a stand mixer S, including by engagement of the input hub 36 with the mounting feature M of the stand mixer S. If the plunger 22 has been left in the extended position, the user can rotate the lever 90 in the required direction to effect lifting of the plunger 22 into the retracted position, as discussed above (if the plunger 22 has been left in the retracted position, no such action is required). The blade assembly 122 corresponding with the desired ice shaving size can then be assembled with the rest of the ice block-receiving chamber 12 (such as by alignment and twisting engagement of a bayonet-style fitting or the like, pressing together a snap-fit engagement, or the like). The sleeve 72 can then be positioned within the interior cavity 14 and the ice block 62 can be inserted into the sleeve 72 within the interior cavity 14. The ice block-receiving chamber 12, including the ice block 62, can then be assembled with the upper housing 34 (again, buy alignment and twisting engagement of a bayonet fitting or the like). The lever 90 can then be turned in the required direction for release of the plunger 22 such that the spring 64 forces the pusher 48 into engagement with the ice block 62 (including by engagement of the gripping feature 76 with the ice block 62). The user can then turn on the stand mixer S (including to a recommended setting given the specific mixer, the selected blade assembly 122, and/or the composition of the ice block 62, etc.) to cause turning of the ice block 62, under pressure, over the edge 26 of the blade 20 to dispense ice shavings from the output opening 18, as shown in FIG. 12, for collection into a bowl, for example. When the ice block 62 has been processed (including to the extent permitted by the specific assembly 10), the lever 90 can be turned to lift the plunger 22 for retention back in the retracted position. The user can then remove the ice block-receiving chamber 12 for cleaning, storage, or processing of further ice blocks 62, as discussed above (including using different blade assemblies 122).

The invention disclosed herein is further summarized in the following paragraphs and is further characterized by combinations of any and all of the various aspects described therein. According to an aspect of the disclosure, an attachment for a stand mixer includes an ice block-receiving chamber having an inner cavity and a lower side defining an output opening and a blade in a fixed position along a portion of the opening and partially extending into the inner cavity. The attachment for a stand mixer further includes a plunger mounted with respect to the ice block-receiving chamber so as to be moveable into the inner cavity toward the lower side along an axis and to be rotatable around the axis, the blade having an edge that extends axially away from the axis and a drive shaft having an input end coupleable to a power output of the stand mixer and a drive end mechanically coupled with the plunger to drive rotation thereof about the axis.

The attachment may further include an upper housing defining an input hub with which the input end of the drive shaft is rotatably mounted. The upper housing may enclose the drive end of the drive shaft and defines a lower end with which the ice-block receiving chamber is removably attachable. The plunger may be mounted with the housing so as to be mounted with respect to the ice block-receiving cavity by attachment of the ice-block receiving cavity with the housing.

The input hub may be configured to be received with a mounting feature of the stand mixer surrounding the power output thereof.

The plunger may include an axle, a pusher extending radially outward from an operating end of the axle, and a lifting block on an end opposite the operating end. The plunger can be mounted with respect to the ice block-receiving chamber by a mounting mechanism fixable with respect to the ice block-receiving chamber. The mounting mechanism may include a biasing member exerting an axial force on the lifting block in a first direction toward the lower side of the ice block-receiving chamber and lever applying a force on the lifting block opposite the first direction.

The plunger may further include a lifting bar coupled with the lifting block and extending radially outward from the axis. The lever can be rotatable about the axis, and the mounting mechanism can further include an annular member including a first angled track disposed around a portion of the annular member and receiving an end of the lifting bar. The annular member may be operated on by rotation of the lever to effect rotation of the track to apply the force on the lifting block opposite the first direction.

The attachment can further include a driven gear receiving a portion of the axle such that the axle is slidably disposed through the driven gear along the axis and is rotatably fixed with the driven gear about the axis. The drive shaft may include a drive gear fixed on the output end thereof, the drive gear operably engaged with the driven gear to cause rotation of the axle.

The pusher can define a plurality of spikes configured to engage a portion of an ice block positioned within the ice block-receiving chamber such that the plunger rotates the ice block over the blade under the axial force applied on the lifting block by the biasing member.

The attachment can further include a sleeve receivable within the inner cavity of the ice block-receiving chamber and including at least one spiral rib extending inward from the sleeve with respect to the inner cavity. The at least one spiral rib can extend toward the lower side of the ice block-receiving chamber and around the sleeve in a direction corresponding with the rotation of the plunger about the axis driven by the drive shaft.

According to another aspect of the present disclosure, a shave-ice maker includes an ice block-receiving chamber having an inner cavity and a lower side defining an output opening and a blade in a fixed position along a portion of the opening and partially extending into the inner cavity and an upper housing releasably retaining the ice block-receiving chamber. The shave-ice maker further includes a plunger mounted with the upper housing so as to be moveable into the inner cavity toward the lower side along an axis and to be rotatable around the axis. The plunger includes an axle and a pusher extending radially outward from an operating end of the axle. A driven gear receives a portion of the axle such that the axle is slidably disposed through the driven gear along the axis and is rotatably fixed with the driven gear about the axis, and a biasing member exerts an axial force on a second end of the axle, positioned opposite the operating end, in a first direction toward the lower side of the ice block-receiving chamber and lever applying a force on a second end of the axle opposite the operating end.

The second end of the plunger can be defined on a lifting block, and the plunger can further include a lifting bar coupled with the lifting block and extending radially outward from the axis. The upper housing can further include an annular member including a first angled track disposed around a portion of the annular member and receiving an end of the lifting bar and a lever rotatably mounted on the upper housing and, the annular member being operated on by rotation of the lever to effect rotation of the track to apply the force on the lifting block opposite the first direction.

The shave-ice maker can further include a sleeve receivable within the inner cavity of the ice block-receiving chamber and including at least one spiral rib extending inward from the sleeve with respect to the inner cavity. The at least one spiral rib may extend toward the lower side of the ice block-receiving chamber and around the sleeve in a direction corresponding with the rotation of the plunger.

The pusher may define a plurality of spikes configured to engage a portion of an ice block positioned within the ice block-receiving chamber such that the plunger rotates the ice block over the blade under the axial force applied on the lifting block by the biasing member The shave-ice maker can further include a drive shaft having an input end coupleable to a power output of a stand mixer and a drive gear mounted thereon and mechanically coupled with the plunger to drive rotation thereof about the axis.

The upper housing may define an input hub with which the input end of the drive shaft is rotatably mounted, enclosing the drive gear of the drive shaft.

According to yet another aspect, a shave-ice making kit includes a primary unit having an ice block-receiving chamber with an inner cavity, a lower side defining an output opening, and a blade in a fixed position along a portion of the opening and partially extending into the inner cavity and a plunger mounted with respect to the ice block-receiving chamber so as to be moveable into the inner cavity toward the lower side along an axis and to be rotatable around the axis. The plunger includes an axle and a pusher extending radially outward from an operating end of the axle. The kit further includes an ice mold defining an inner mold cavity sized to receive a volume of water for freezing into an ice block for receipt within the inner cavity of the ice-block receiving chamber.

The ice mold may be one of a plurality of ice molds included within the kit, and the kit may further include a plurality of lids configured to enclose the inner mold cavities of the plurality of ice molds.

The pusher may define at least one gripping feature configured to engage a portion of an ice block positioned within the ice block-receiving chamber such that the plunger rotates the ice block over the blade, and the ice mold may include at least one protrusion extending into the inner mold cavity to impart a receiving feature in the ice bock corresponding with the at least one gripping feature.

The at least one gripping feature may comprise a plurality of spikes arranged in first and second perpendicular lines extending across a portion of a diameter of the pusher, and the protrusion may define first and second perpendicular ridges in locations correlating with locations of the first and second perpendicular lines.

The kit may further include a sleeve receivable within the inner cavity of the ice block-receiving chamber and including at least one spiral rib extending inward from the sleeve with respect to the inner cavity. The at least one spiral rib may extend toward the lower side of the ice block-receiving chamber and around the sleeve in a direction corresponding with the rotation of the plunger. The inner mold cavity can be configured such that the ice block is receivable within the inner cavity of the ice-block receiving chamber in contact with the at least one spiral rib.

The primary unit can further include a drive shaft having an input end coupleable to a power output of a stand mixer and a drive gear mounted thereon and mechanically coupled with the plunger to drive rotation thereof about the axis, an upper housing defining an input hub with which the input end of the drive shaft is rotatably mounted, enclosing the drive gear of the drive shaft, releasably retaining the ice block-receiving chamber, the plunger being mounted with the upper housing, and a biasing member exerting an axial force on a second end of the axle, positioned opposite the operating end, in a first direction toward the lower side of the ice block-receiving chamber and lever applying a force on a second end of the axle opposite the operating end.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An attachment for a stand mixer, comprising:

an ice block-receiving chamber having an inner cavity and a lower side defining an output opening and a blade in a fixed position along a portion of the opening and partially extending into the inner cavity;

a plunger mounted with respect to the ice block-receiving chamber so as to be moveable into the inner cavity toward the lower side along an axis and to be rotatable around the axis, the blade having an edge that extends axially away from the axis; and a drive shaft having an input end coupleable to a power output of the stand mixer and a drive end mechanically coupled with the plunger to drive rotation thereof about the axis.

2. The attachment for a stand mixer of claim 1, further including an upper housing, the upper housing defining an input hub with which the input end of the drive shaft is rotatably mounted, enclosing the drive end of the drive shaft, and defining a lower end with which the ice-block receiving chamber is removably attachable; wherein:

the plunger is mounted with the housing so as to be mounted with respect to the ice block-receiving cavity by attachment of the ice-block receiving cavity with the housing.

3. The attachment for a stand mixer of claim 2, wherein the input hub is configured to be received with a mounting feature of the stand mixer surrounding the power output thereof.

4. The attachment for a stand mixer of claim 1, wherein the plunger:

includes an axle, a pusher extending radially outward from an operating end of the axle, and a lifting block on an end opposite the operating end; and is mounted with respect to the ice block-receiving chamber by a mounting mechanism fixable with respect to the ice block-receiving chamber and including a biasing member exerting an axial force on the lifting block in a first direction toward the lower side of the ice block-receiving chamber and lever applying a force on the lifting block opposite the first direction.

5. The attachment for a stand mixer of claim 4, wherein:

the plunger further includes a lifting bar coupled with the lifting block and extending radially outward from the axis;

the lever is rotatable about the axis; and the mounting mechanism further includes an annular member including a first angled track disposed around a portion of the annular member and receiving an end of the lifting bar, the annular member being operated on by rotation of the lever to effect rotation of the track to apply the force on the lifting block opposite the first direction.

6. The attachment for a stand mixer of claim 4, further comprising a driven gear receiving a portion of the axle such that the axle is slidably disposed through the driven gear along the axis and is rotatably fixed with the driven gear about the axis, wherein:

the drive shaft includes a drive gear fixed on the output end thereof, the drive gear operably engaged with the driven gear to cause rotation of the axle.

7. The attachment for a stand mixer of claim 4, wherein the pusher defines a plurality of spikes configured to engage a portion of an ice block positioned within the ice block-receiving chamber such that the plunger rotates the ice block over the blade under the axial force applied on the lifting block by the biasing member.

8. The attachment for a stand mixer of claim 1, further including a sleeve receivable within the inner cavity of the ice block-receiving chamber and including at least one spiral rib extending inward from the sleeve with respect to the inner cavity, the at least one spiral rib extending toward the lower side of the ice block-receiving chamber and around the sleeve in a direction corresponding with the rotation of the plunger about the axis driven by the drive shaft.

9. A shave-ice maker, comprising:

an ice block-receiving chamber having an inner cavity and a lower side defining an output opening and a blade in a fixed position along a portion of the opening and partially extending into the inner cavity;

an upper housing releasably retaining the ice block-receiving chamber;

a plunger mounted with the upper housing so as to be moveable into the inner cavity toward the lower side along an axis and to be rotatable around the axis, the plunger including an axle and a pusher extending radially outward from an operating end of the axle;

a driven gear receiving a portion of the axle such that the axle is slidably disposed through the driven gear along the axis and is rotatably fixed with the driven gear about the axis; and a biasing member exerting an axial force on a second end of the axle, positioned opposite the operating end, in a first direction toward the lower side of the ice block-receiving chamber and lever applying a force on a second end of the axle opposite the operating end.

10. The shave-ice maker of claim 9, wherein:

the second end of the plunger is defined on a lifting block, the plunger further including a lifting bar coupled with the lifting block and extending radially outward from the axis;

the upper housing further includes an annular member including a first angled track disposed around a portion of the annular member and receiving an end of the lifting bar and a lever rotatably mounted on the upper housing and, the annular member being operated on by rotation of the lever to effect rotation of the track to apply the force on the lifting block opposite the first direction.

11. The shave-ice maker of claim 9, further including a sleeve receivable within the inner cavity of the ice block-receiving chamber and including at least one spiral rib extending inward from the sleeve with respect to the inner cavity, the at least one spiral rib extending toward the lower side of the ice block-receiving chamber and around the sleeve in a direction corresponding with the rotation of the plunger.

12. The shave-ice maker of claim 9, wherein the pusher defines a plurality of spikes configured to engage a portion of an ice block positioned within the ice block-receiving chamber such that the plunger rotates the ice block over the blade under the axial force applied on the lifting block by the biasing member.

13. The shave-ice maker of claim 9, further including a drive shaft having an input end coupleable to a power output of a stand mixer and a drive gear mounted thereon and mechanically coupled with the plunger to drive rotation thereof about the axis.

14. The shave-ice maker of claim 13, wherein the upper housing defines an input hub with which the input end of the drive shaft is rotatably mounted, enclosing the drive gear of the drive shaft.

15. A shave-ice making kit, comprising:

a primary unit including:

an ice block-receiving chamber having an inner cavity and a lower side defining an output opening and a blade in a fixed position along a portion of the opening and partially extending into the inner cavity; and a plunger mounted with respect to the ice block-receiving chamber so as to be moveable into the inner cavity toward the lower side along an axis and to be rotatable around the axis, the plunger including an axle and a pusher extending radially outward from an operating end of the axle;

a sleeve receivable within the inner cavity of the ice block-receiving chamber and including at least one spiral rib extending inward from the sleeve with respect to the inner cavity, the at least one spiral rib extending toward the lower side of the ice block-receiving chamber and around the sleeve in a direction corresponding with the rotation of the plunger; and an ice mold defining an inner mold cavity sized to receive a volume of water for freezing into an ice block for receipt within the inner cavity of the ice-block receiving chamber, wherein the inner mold cavity is configured such that the ice block is receivable within the inner cavity of the ice-block receiving chamber in contact with the at least one spiral rib.

16. The shave-ice making kit of claim 15, wherein:

the ice mold is one of a plurality of ice molds included within the kit; and the kit further includes a plurality of lids configured to enclose the inner mold cavities of the plurality of ice molds.

17. The shave-ice making kit of claim 15, wherein:

the pusher defines at least one gripping feature configured to engage a portion of an ice block positioned within the ice block-receiving chamber such that the plunger rotates the ice block over the blade; and the ice mold includes at least one protrusion extending into the inner mold cavity to impart a receiving feature in the ice bock corresponding with the at least one gripping feature.

18. The shave-ice making kit of claim 17, wherein:

the at least one gripping feature comprises a plurality of spikes arranged in first and second perpendicular lines extending across a portion of a diameter of the pusher; and the protrusion defines first and second perpendicular ridges in locations correlating with locations of the first and second perpendicular lines.

19. The shave-ice making kit of claim 15, wherein the primary unit further includes:

a drive shaft having an input end coupleable to a power output of a stand mixer and a drive gear mounted thereon and mechanically coupled with the plunger to drive rotation thereof about the axis; and an upper housing defining an input hub with which the input end of the drive shaft is rotatably mounted, enclosing the drive gear of the drive shaft, releasably retaining the ice block-receiving chamber, the plunger being mounted with the upper housing.

20. The shave-ice making kit of claim 19, wherein the primary unit further includes a biasing member exerting an axial force on a second end of the axle, positioned opposite the operating end, in a first direction toward the lower side of the ice block-receiving chamber and lever applying a force on a second end of the axle opposite the operating end.

* * * * *